US007559409B2

(12) United States Patent
Bärneman et al.

(10) Patent No.: US 7,559,409 B2
(45) Date of Patent: Jul. 14, 2009

(54) PROCEDURE AND APPARATUS FOR THE INSTALLATION OF AN ELEVATOR

(75) Inventors: Håkan Bärneman, Solna (SE); Gert Van Der Meijden, Otterlo (NL); Istvan Toth, Kista (SE)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 10/053,578

(22) Filed: Jan. 24, 2002

(65) Prior Publication Data

US 2002/0066622 A1 Jun. 6, 2002

Related U.S. Application Data

(62) Division of application No. 09/180,353, filed as application No. PCT/FI98/00207 on Mar. 6, 1998, now Pat. No. 6,357,556.

(30) Foreign Application Priority Data

Mar. 7, 1997 (FI) ..... 970969
Mar. 7, 1997 (FI) ..... 970971

(51) Int. Cl.
*B66B 7/00* (2006.01)
*B66B 9/00* (2006.01)

(52) U.S. Cl. ..... 187/408; 187/414; 187/900

(58) Field of Classification Search ..... 187/406–408, 187/414, 900; 294/19.1
See application file for complete search history.

(56) References Cited

U.S. PATENT DOCUMENTS 3,072,429 A * 1/1963 Stipan ..... 294/19.1
3,774,953 A * 11/1973 Babcock ..... 294/19.1
3,851,736 A * 12/1974 Westlake et al. ..... 52/745.2
4,635,986 A * 1/1987 Johns ..... 294/19.1
5,014,822 A * 5/1991 Chapelain et al. ..... 187/408
5,065,843 A * 11/1991 Richards ..... 187/408
5,116,260 A * 5/1992 Upchurch ..... 114/221 R
5,230,404 A * 7/1993 Klein ..... 187/414
6,022,059 A * 2/2000 Regamey ..... 294/24
6,138,797 A * 10/2000 Pettersson et al. ..... 187/900 X
7,137,485 B2 * 11/2006 Barneman et al. ..... 187/408
2006/0243539 A1 * 11/2006 Cruz et al. ..... 187/408

FOREIGN PATENT DOCUMENTS

EP 0 457 152 A2 11/1991
EP 0501140 B1 7/1993

(Continued)

OTHER PUBLICATIONS

Wolfram Arnold, "3..2..1..Lift Off in Leipzig", in "Lift-Report", vol. 3 1996, p. 72.

(Continued)

*Primary Examiner*—James Keenan
(74) *Attorney, Agent, or Firm*—Birch, Stewart, Kolasch & Birch, LLP

(57) ABSTRACT

An apparatus for the installation of an elevator includes at least one suspension element fixed to the upper part of the elevator shaft, to which element is fitted a suspension device used to support shaft equipment during installation. The suspension device is mounted on the suspension element using a mounting tool from top floor landing.

18 Claims, 4 Drawing Sheets

FOREIGN PATENT DOCUMENTS

| | | | | |
|---|---|---|---|---|
| EP | 0767134 | A2 | 4/1997 | |
| JP | 1-127585 | | 5/1989 | |
| JP | 1-321281 | | 12/1989 | |
| JP | 2-295877 | | 12/1990 | |
| JP | 2-305785 | | 12/1990 | |
| JP | 3-88685 | | 4/1991 | |
| JP | 3-267283 | | 11/1991 | |
| JP | 5-24773 | | 2/1993 | |
| JP | 5-124778 | A * | 5/1993 | ..... 187/414 |
| JP | 5-238658 | A * | 9/1993 | |
| JP | 5-330758 | | 12/1993 | |
| JP | 5-338952 | | 12/1993 | |
| JP | 07237848 | | 9/1995 | |
| JP | 8-245114 | | 9/1996 | |
| JP | 8-259142 | | 10/1996 | |
| WO | WO 457152 | A2 | 11/1991 | |

OTHER PUBLICATIONS

Layout Template for B5 GWD, Westinghouse Elevator Co., A Division of Schindler Corp., Morristown, New Jersey, Apr. 2000.

Field Method Manual, Otis 2000 Method, Chapter 5, Sheet 5.6, p. 1, Dec. 1995.

Field Construction Manual, Otis Homelift, Rails Lifting, pp. 1-10, Jun. 2000.

Field Method Manual, Otis 200 Method, Chapter 4, Sheet 4.1, p. 1, Dec. 1995.

Otis Inst. Drawings 2000E.

* cited by examiner

PROCEDURE AND APPARATUS FOR THE INSTALLATION OF AN ELEVATOR

This application is a divisional of Application No. 09/180,353, filed on Jan. 6, 1999 now U.S. Pat. No. 6,357,556 and for which priority is claimed under 35 U.S.C. § 120. Application No. 09/180,353 is the national phase of PCT International Application No. PCT/FI98/00207 filed on Mar. 6, 1998 under 35 U.S.C. § 371. The entire contents of each of the above-identified applications are hereby incorporated by reference. This application also claims priority of Application No. 970971 filed in Finland on Mar. 7, 1997 and Application No. 970969 filed in Finland on Mar. 7, 1997 under 35 U.S.C. § 119.

FIELD OF THE INVENTION

The present application relates to a procedure and to an apparatus for installing an elevator.

DESCRIPTION OF THE BACKGROUND ART

The installation of an elevator is a critical stage in a building project. The elevator must be available for use as early as possible during the construction period. The elevator should function at this stage in the same way as it will in a finished building, and e.g. the safety equipment must be in operation. On the other hand, the elevator should be installed as quickly as possible without causing disturbances in other construction work. Special installations intended for the installation and construction period should be kept to a minimum and the elevator should be directly installed in its final form to avoid the need for later adjustments and trimming. The elevator must be installed quickly and economically. Additional features to the standard requirements are encountered in the installation of an elevator without machine room, in which all the shaft equipment must be mainly installed in the shaft space.

SUMMARY OF THE INVENTION

The object of the present invention is to create a new and economical solution for the installation of an elevator. To achieve this, the procedure of the invention comprises the steps of fixing at least one suspension element to an upper part of the elevator shaft; placing a suspension device on the at least one suspension element, the suspension device supports equipment during the installation procedure; providing a hositing device on the suspension device; and supporting an elevator car by the hoisting device in the elevator shaft, the elevator car being used during the installing procedure. The apparatus of the invention comprises a suspension element, the suspension element being attachable to a ceiling of an elevator shaft or an upper part of a wall of the elevator shaft, and suspension means for carrying or supporting shaft equipment at least during installation.

By using the solution of the invention, the shaft equipment for an elevator can be installed quickly and reliably. The entire installation work can be carried out in the shaft and from the top and bottom floor landings. No equipment outside the shaft is needed during the installation, and the installation can be carried out without disturbing other construction work and conversely, without other construction work disturbing elevator installation.

One idea of the invention is to install an elevator without any scaffolding in the shaft. Everything will be done from outside on the topmost floor and from the roof of the car.

According to the invention the pulley with the rope for the installation hoist is fixed with a stick to a lifting hook in the top of the well while working on the top floor. Similarly fixing the overspeed governor with a special hanger to a fixing point in top of the well.

When installing the complete elevator using the method of the invention, the installation is started at the bottom of the pit and goes upwards using the car as a working platform to install the guide rails. A special hoist is used to drive the car and lift the guide rails.

Further, when the method of the present invention is used also the fixing of the supporters for the plumbing jig when working outside the shaft. Also other tasks of aligning the shaft component is carried out from outside at the topmost floor. such as: aligning and fixing the jog to the supporters, lowering down the plumbing lines, doing all the measurements of the shaft alignment and adjusting the jig with all the plumbing wires at the same time.

According to a preferred embodiment of the invention, during the installation of the elevator the overspeed governor is at least in the vertical direction so adjusted that it corresponds to the final placement of the overspeed governor and after the elevator installation the overspeed governor is detached from the suspension element and fixed in its final mounting point. An element for supporting the overspeed governor is fitted to a suspension element. Further, in a preferred case, the overspeed governor is mounted on the suspension element and the position at least in the vertical direction is adjusted so that it corresponds to the final position of installation of the overspeed governor and the overspeed governor ropes are adjusted substantially to their final length. The overspeed governor can be utilised during elevator installation and can be easily installed in its final place without readjusting the rope lengths.

The various pieces of shaft equipment, such as guide rails and landing doors and even the elevator drive machine, are transported from the bottom of the shaft to their final place of installation by means of the elevator car. Separate erecting stages are unnecessary and no assembly scaffolds need to be built.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described by the aid of some of its embodiments by referring to the drawings which are given by way of illustration only, and thus are not limitative of the present invention, and in which.

DETAILED DESCRIPTION OF THE PREFERRED EMBODIMENTS

Figure 1:
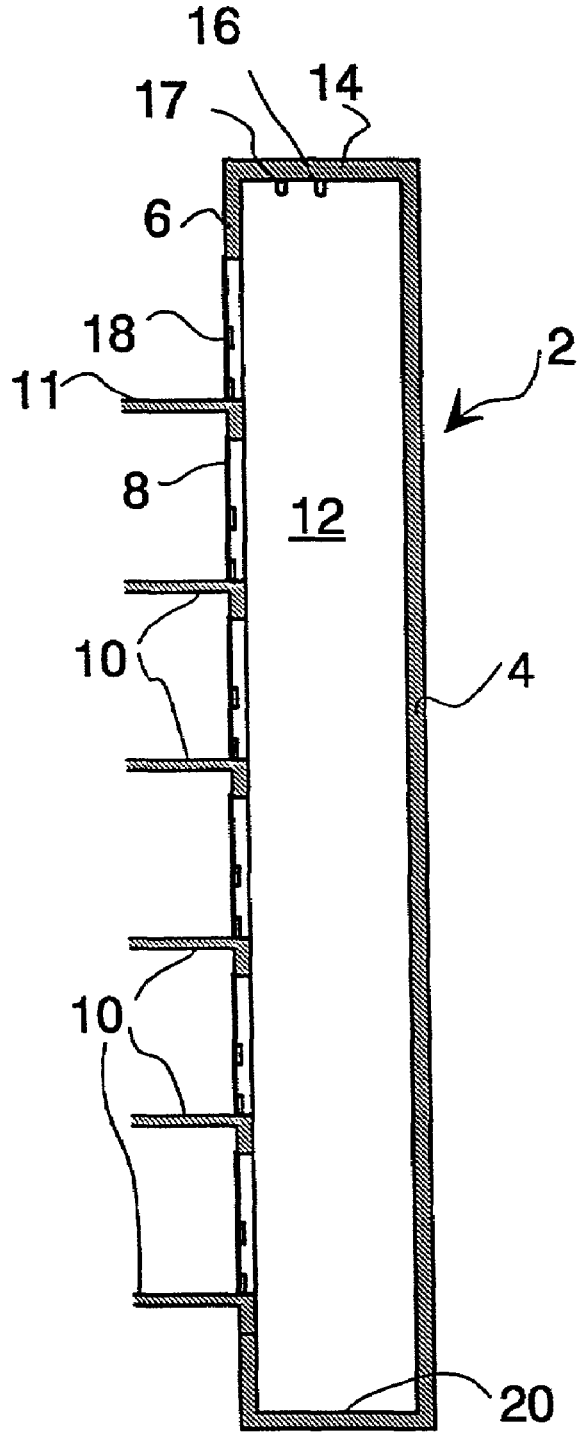
FIG. 1 presents an elevator shaft before the elevator is installed, FIG. 2 presented the upper part of the shaft when the suspension rope is being mounted.

FIG. 1 shows a cross-section of the elevator shaft 2 before installation of the elevator. The shaft comprises a back wall 4 and front wall 6 with door openings 8 at the landings 10 and 11, and side walls 12. Fixed to the shaft ceiling 14 are suspension elements, such as suspension loops 16, 17 and 19. There are three suspension loops fixed to the shaft ceiling, of which the first suspension loop 16 is used to mount a hoisting device, the second suspension loop 17 is used for temporary installation of the overspeed governor and the third suspension loop 19 is used as an auxiliary suspension means during installation as explained in detail later on. The shaft extends somewhat below the lowest floor, forming a pit in which the shaft equipment needed below the elevator car is installed. The door openings are provided with temporary safety walls 18, which may consist of e.g. plastic plates, wooden beams or steel bars.

Figure 2:
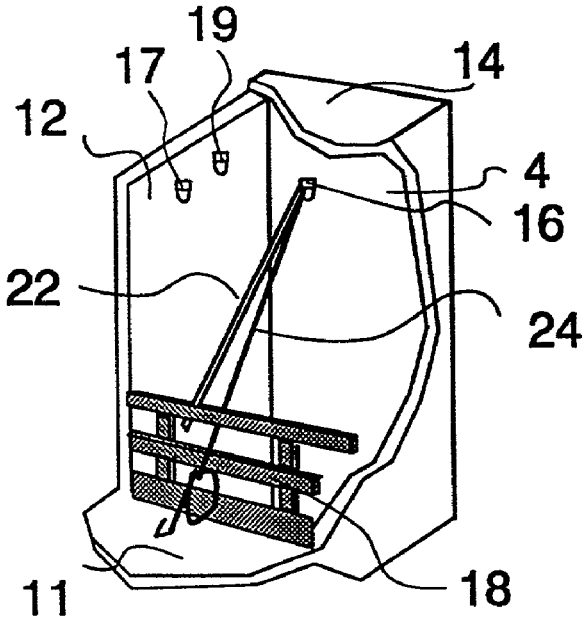
Figure 3:
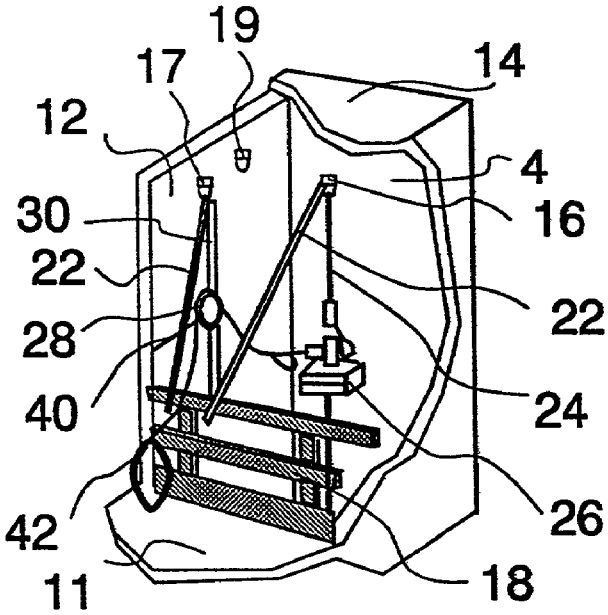
FIG. 3 presents the upper part of the shaft when the overspeed governor is being mounted.
Figure 5:
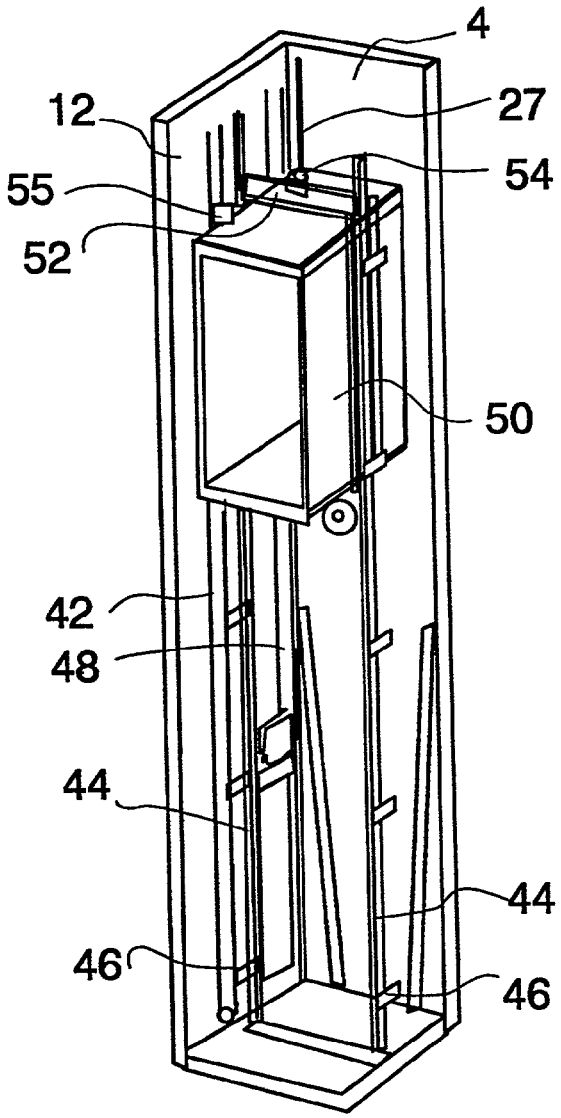
FIG. 5 illustrates the hoisting of the guide rails.
Figure 4:
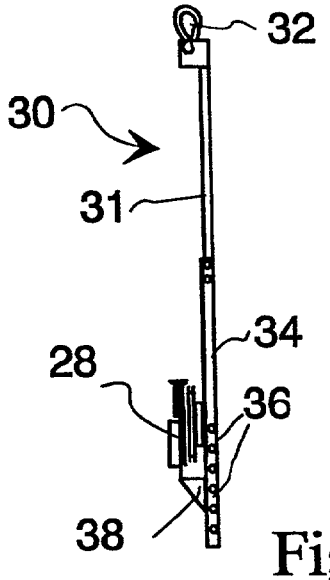
FIG. 4 presents means for mounting the overspeed governor.
Figure 6:
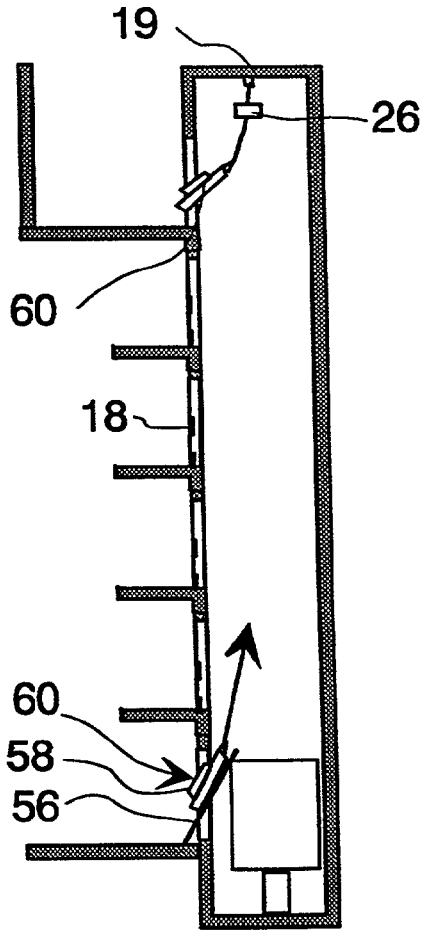
FIG. 6 illustrates the hoisting of the drive machine into the shaft.

As illustrated by FIG. 2, a suspension means such as a suspension rope 24 is fixed to the suspension loops 16 in the shaft ceiling using a mounting tool 22. The mounting tool has a slot at one end, to which a clamp at the end of a rope can be fitted. Using the mounting tool, the clamp can be set on the suspension loops by means of a fast coupling from the top floor 11. The suspension rope is attached to a hoisting device 26 (FIG. 3), by means of which the shaft equipment can be hoisted from the shaft bottom to the mounting height. Using a mounting tool 22, an installation-time frame 30 for the overspeed governor 28 is mounted on suspension loop 17. The frame 30 (FIG. 4) comprises a fastening hook 32 fitted to the end of a rod 31, allowing it to be mounted on a suspension loop 17, and an adjusting bar 34 fitted to the other end of the rod 31. The adjusting bar is provided with a series of mounting holes 36, in which a mounting base 38 for the overspeed governor can be fixed. The final mounting height 40 of the overspeed governor in the elevator shaft is marked on the side wall 12 and the overspeed governor is adjusted to the correct height by using the mounting holes in the adjusting bar. After the overspeed governor 28 has been fixed to its installation-time position, the overspeed governor rope 42 is fitted into the groove of the rope pulley of the overspeed governor and dropped into the shaft and fitted onto a diverting pulley mounted in the bottom part of the shaft. The overspeed governor rope is adjusted to its final length, whereupon the overspeed governor is ready for use in elevator operation during installation. After the installation, the overspeed governor is removed from its installation-time frame and fixed to an elevator guide rail at the same height.

The guide rails are installed starting from the bottom of the shaft by fixing the lowest car guide rails 44 to the side walls of the elevator shaft by means of rail clamps 46. The guide rails are positioned to their proper locations, which have been determined by plumbing using plumb lines, and adjusted to an upright position using a spirit level. The counterweight guide rails 48 are installed correspondingly by using e.g. a suitable gauge to adjust the distance from the car guide rails. After the first pair of guide rails has been installed, the elevator car 50 is mounted in the lower part of the shaft and a lifting hook 54 is fixed to the overhead beam 52 of the frame of the elevator car. Using a hoist 26 and its hoisting rope 27 attached to the lifting hook, the car is hoisted in the shaft during installation. Instead of the elevator car, it is also possible to mount a special erecting stage in the shaft.

On the top of the car, a safety pedal 55 is mounted. The safety pedal is connected to the safety gear by the overspeed governor rope or a separate rope or lever so that when the safety pedal is in its up position, the safety gear is active. When an installer is working on the car top and wants to lower the car, he/she must press the safety pedal to release the safety gear, and correspondingly when the installer releases the pedal, the safety gear grips. In this way, reliable stopping is achieved when the elevator car is to be stopped independently of the installation hoist. Moreover, the car is attached to the overspeed governor rope 42 in the normal manner, so that acceleration of the car beyond the triggering limit of the safety gear will result in activating the safety gear as is known in elevator technology. If the safety gear has been activated either by operation of the safety pedal or triggering of the overspeed governor, moving the car in the up direction will release the safety gear. During installation, the car is moved up close to the upper end of the guide rail already installed, and fastened to the guide rail with a safety rope. Thus, during the installation of the guide rail, the car is fixed in place with a safety rope independent of the safety equipment of the elevator. The guide rail 54 to be installed next is lifted to the top of the car by means of a hoist and then installed. Proceeding in this manner, the guide rails are installed floor by floor up to the top floor landing.

The last section of one of the car guide rails is installed together with the drive machine of the elevator. The elevator drive machine 58 is fixed to the guide rail section 56 on the bottom floor and, using an installation hoist 26, the drive machine-guide rail combination 60 is hoisted through the bottom floor door opening and through the gap between the elevator car and the door opening into the shaft and further up the shaft to the top floor landing. The drive machine-guide rail combination 60 is hoisted to the level of the top floor using the installation hoist, whereupon it is pulled onto the top floor landing using an auxiliary hoist mounted on the floor. The elevator car is then hoisted to a level somewhat below the top floor and locked in place by means of safety ropes so that the drive machine-guide rail combination can be installed from car top. The drive machine-guide rail combination can be installed from car top. The drive machine-guide rail combination 60 is lifted into position by means of the hoist (not shown), which is connected to the hoisting loop 19, and fixed in place. The drive machine-guide rail combination 60 can be brought to the place of installation by different means depending on what sort of means are available. Thus, the drive machine-guide rail combination 60 can also be lifted directly to the top floor landing by using a construction hoist if one is available and if there is an access to the top floor from above. If there are two installation hoists available, then one of them can be used to hoist the drive machine-guide rail combination 60 while the other one is used to hoist the car to the installation height.

The elevator drive machine is preferably transported to the site of installation packed in a framework having at its bottom edge at least the beams supporting the machine. These supporting beams are provided with ready-made bore holes allowing axles to be fitted in them. The axles are provided with rotatable wheels to carry the elevator drive machine, allowing it to be moved at the site from a means of transport, such as a lorry, to the immediate vicinity of the shaft.

Figure 7:
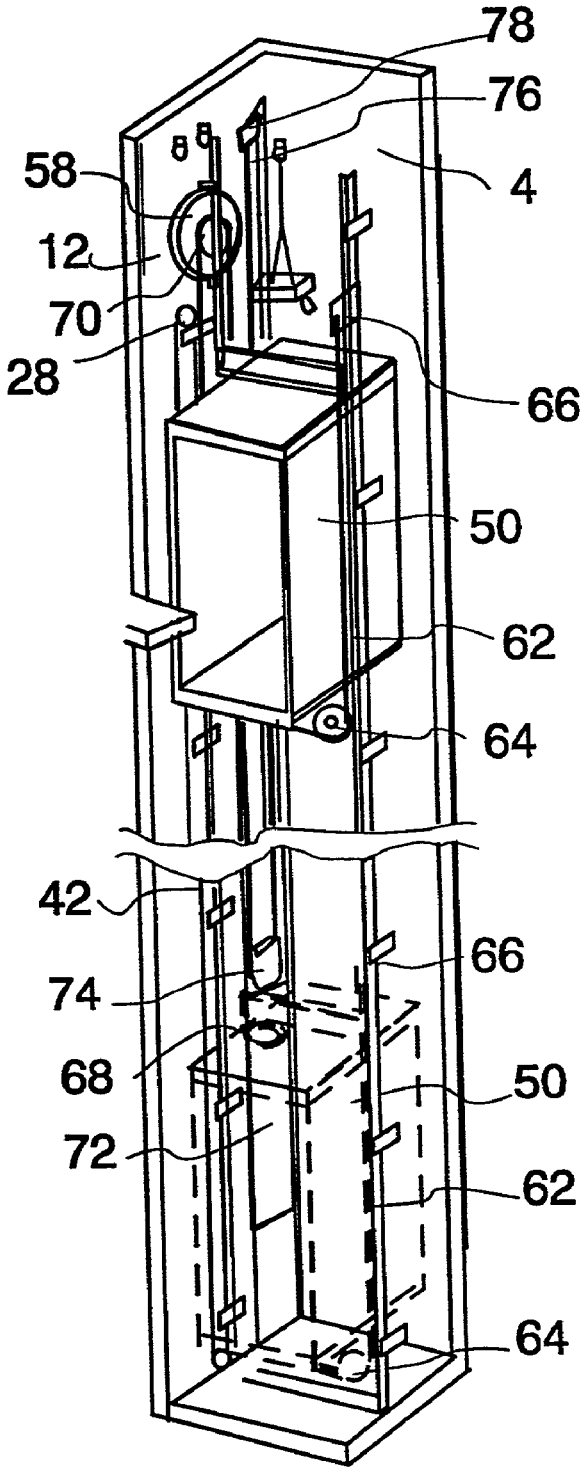
FIG. 7 presents the shaft with the drive machine, guide rails and car installed.

To install the elevator ropes 62, the elevator car 50 is lowered to a level near the bottom of the elevator shaft as indicated by the broken-line illustration in FIG. 7. The elevator ropes 62 are threaded manually from the car top via diverting pulleys 64 under the car to the other side of the car and fastened to a rope fixture 66 fixed to the guide rail somewhat above the car. The rope coils 68 are suitably tied on the car top. The rope fixture 66 is detached and the car 50 is hoisted to a level slightly below the top floor (solid lines). The ropes are then passed one at time over the traction sheave 70 and the rope loop is lowered to the counterweight 72, which is resting on the buffers on the shaft bottom. After this, the rope loops are passed around the diverting pulley 74 of the counterweight and the second ends 76 of the ropes are placed in a rope clamp fixed to a counterweight guide rail. The counterweight 72 is set to the correct height and the second ends 76 of the ropes are cut to a suitable length and fastened definitively in the rope clamp.

Using the installation hoist, the doors for the landing door openings are hoisted with the car to the landings via the shaft and mounted on previously installed supporters. The elevator car is used as a measurement aid to adjust the horizontal position of the landing doors.

According to an embodiment, a diverting pulley is suspended from a suspension element in the shaft ceiling and the hoisting cable of the installation hoist is passed over the diverting pulley. The installation hoist is fixed to the elevator frame on the top of the elevator car so that it is readily available for use by installers working on the car top. To allow the elevator car to be lifted and lowered during installation, the other end of the hoisting cable is attached to the elevator car, thus forming a 1:2 suspension ratio, which makes it possible to use an installation hoist with a lower hoisting capacity. When shaft equipment is being hoisted up from the shaft bottom, the elevator car remains locked in place and the hoist is used with a 1:1 suspension ratio. When the guide rails and landing doors are being hoisted to the mounting height using the elevator car, installers do not have to be on the bottom of the shaft, but instead they can work from the top of the elevator car both during the hoisting and during the installation.

In the foregoing, the invention has been described by the aid of one of its embodiments. However, the presentation is not to be regarded as constituting a restriction of the sphere of patent protection, but the embodiments of the invention may be varied within the limits defined by the following claims. For instance, instead of being fixed to the shaft ceiling, the suspension element may as well be attached to an element provided in the upper part of the shaft, such as a supporting beam fixed to the shaft walls.

The invention claimed is:

1. A kit for installing shaft equipment for an elevator, the kit comprising;

at least one guide rail;

a first suspension element fixable to a ceiling of an elevator shaft or an upper part of a wall of the elevator shaft for temporary support during installation of the elevator;

a second suspension element fixable to the ceiling of the elevator shaft or the upper part of the wall of the elevator shaft for temporary support during installation of the elevator;

a third suspension element fixable to the ceiling of the elevator shaft or the upper part of the wall of the elevator shaft for temporary support during installation of the elevator;

a suspension temporarily mounted to the first suspension element, the suspension configured to carry or support shaft equipment at least during installation, the suspension being connectable to a hoisting device carrying an elevator car, the hoisting device for moving the elevator car during installation of said at least one guide rail, a roof of the elevator car being usable for installation of the shaft equipment and hoisting equipment for the elevator car; and an overspeed governor temporarily mounted to the second suspension element during installation of the shaft equipment, the overspeed governor being mounted to said at least one guide rail after installation of the shaft equipment, wherein the third suspension element is used as an auxiliary suspension during installation of the elevator.

2. The kit as defined in claim 1, further comprising a manually operated mounting tool for setting the suspension on the first suspension element from a top floor.

3. The kit as defined in claim 2, wherein the mounting tool is a bar or rope with one end provided with means for mounting the suspension.

4. The kit as defined in claim 1, further comprising a manually operated mounting tool for setting the overspeed governor on said second suspension element from the top floor.

5. The kit as defined in claim 4, wherein the mounting tool comprises a bar with one end provided with a device for mounting of shaft equipment.

6. The kit as defined in claim 1, wherein the second suspension element further includes a mounting base for the overspeed governor, the mounting base having at least one adjusting element for adjusting a vertical height of the overspeed governor.

7. The kit as defined in claim 1, further comprising at least one elevator rope, the hoisting device being separate from and non-connected to the at least one elevator rope.

8. The kit as defined in claim 1, wherein the roof of the elevator car is useable as a working platform and wherein the elevator car is movable by the hoisting equipment with the roof of the elevator car being the only working platform for workers to stand on within the shaft during installation.

9. The kit as defined in claim 1, wherein a hoisting rope extends from the hoisting device to the elevator car, the hoisting device being adjacent the suspension with the hoisting rope extending along the shaft when the elevator car is at a bottom of the shaft.

10. The kit as defined in claim 1, wherein the hoisting device is adjacent the suspension.

11. The kit as defined in claim 10, wherein the elevator car is movable through out the elevator shaft by the hoisting device which is at the top of the elevator shaft.

12. The kit as defined in claim 11, further including a safety pedal mounted on the roof of the elevator car, the safety pedal controlling release of safety gear to permit movement of the elevator car.

13. The kit as defined in claim 1, further including a safety pedal mounted on the roof of the elevator car, the safety pedal controlling release of safety gear to permit movement of the elevator car.

14. The kit as defined in claim 13, wherein the safety pedal stops movement of the elevator car independently of the hoisting device.

15. The kit as defined in claim 1, wherein the first, second, and third suspension elements are independently fixable to the ceiling of the elevator shaft or the upper part of the wall of the elevator shaft.

16. A kit for installing shaft equipment for an elevator, the kit comprising;

at least one guide rail;

a first suspension element fixable to a ceiling of an elevator shaft or an upper part of a wall of the elevator shaft for temporary support during installation of the elevator;

a second suspension element fixable to the ceiling of the elevator shaft or the upper part of the wall of the elevator shaft for temporary support during installation of the elevator;

a suspension temporarily mounted to the first suspension element, the suspension configured to carry or support shaft equipment at least during installation, the suspension being connectable to a hoisting device carrying an elevator car, the hoisting device for moving the elevator car during installation of said at least one guide rail, a roof of the elevator car being usable for installation of the shaft equipment and hoisting equipment for the elevator car;

an overspeed governor temporarily mounted to the second suspension element during installation of the shaft equipment. the overspeed governor being mounted to said at least one guide rail after installation of the shaft equipment; and a first hand-held manually operated mounting tool for setting the suspension on the first suspension element from a top floor or for setting the overspeed governor on said second suspension element from the top floor.

17. The kit according to claim 16, further comprising a second hand-held manually operated mounting tool, the first hand-held manually operated mounting tool for setting the suspension on the first suspension element from a top floor, the second hand-held manually operated mounting tool for setting the overspeed governor on said second suspension element from the top floor.

18. The kit according to claim 16, further comprising a third suspension element fixable to the ceiling of the elevator shaft or the upper part of the wall of the elevator shaft for temporary support during installation of the elevator, the third suspension element being used as an auxiliary suspension during installation of the elevator.

* * * * *